US006116139A

United States Patent [19]

Yuda, Jr. et al.

[11] Patent Number: 6,116,139

[45] Date of Patent: Sep. 12, 2000

[54] PNEUMATICALLY POWERED LINEAR ACTUATOR CONTROL APPARATUS AND METHOD

[75] Inventors: Lawrence F. Yuda, Jr., Seneca; Prasad Balakrishnan, Westminster, both of S.C.; Edward Camp Tibbals, Jr., Thomasville, N.C.

[73] Assignee: Compact Air Products, Inc., Westminster, S.C.

[21] Appl. No.: 08/689,603

[22] Filed: Aug. 13, 1996

Related U.S. Application Data

[63] Continuation-in-part of application No. 08/610,269, Mar. 4, 1996, which is a continuation of application No. 08/312,057, Sep. 26, 1994, abandoned.

[51] Int. Cl.[7] ..... F01B 13/00; F01B 9/00

[52] U.S. Cl. ..... 91/61; 91/451; 92/136

[58] Field of Search ..... 92/145, 136, 165 PR, 92/DIG. 3; 91/362, 55, 61; 60/399, 400, 403, 407, 327

[56] References Cited

U.S. PATENT DOCUMENTS

| | | | |
|---|---|---|---|
| 1,495,286 | 5/1924 | Williams | 92/136 X |
| 1,549,332 | 8/1925 | Roberts | 92/136 X |
| 2,010,321 | 8/1935 | Renfer | 92/136 X |
| 4,418,781 | 12/1983 | Rabe et al. | 92/136 X |
| 5,577,433 | 11/1996 | Henry | 92/136 X |

*Primary Examiner*—Hoang Nguyen
*Attorney, Agent, or Firm*—Ralph Bailey

[57] ABSTRACT

A combination drive and method for applying power through a piston rod (A) operated by an air cylinder (B) is controlled by an elongated self-locking threaded drive member (C) rotated by an electric motor (D) for affording positioning and velocity control for the air operated cylinder and the guided piston rod which stops and is positively positioned upon cessation of operation of the electric motor. Control apparatus includes a valve housing (35) positioning a spool (40) fixed on one end to the elongated threaded drive member (C), and an assembly (45) for moving the spool axially in respect to the electric motor (D) through an axially compliant coupling (50) so that by controlling the motor the valve is thereby controlled.

11 Claims, 12 Drawing Sheets

Fig. 14.
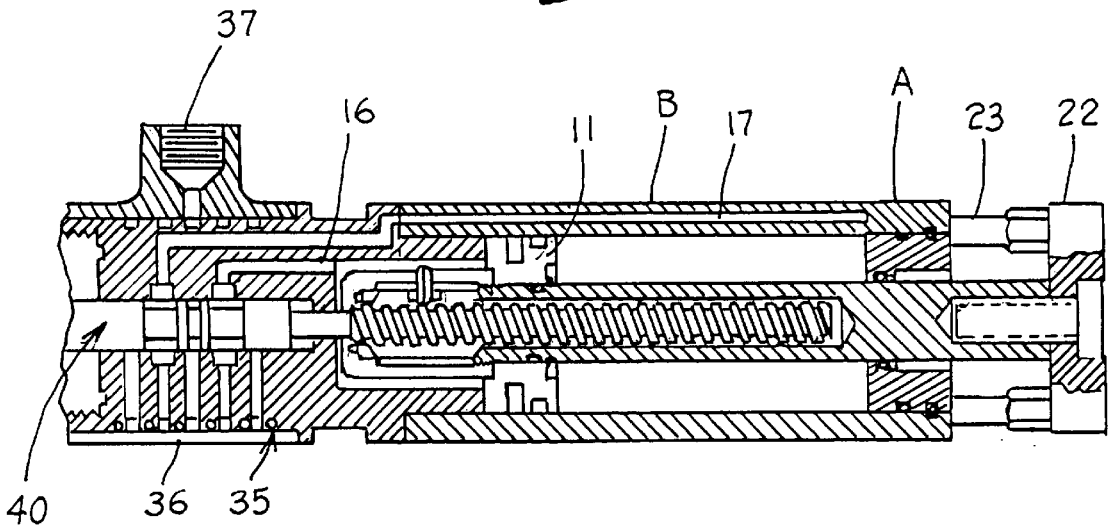
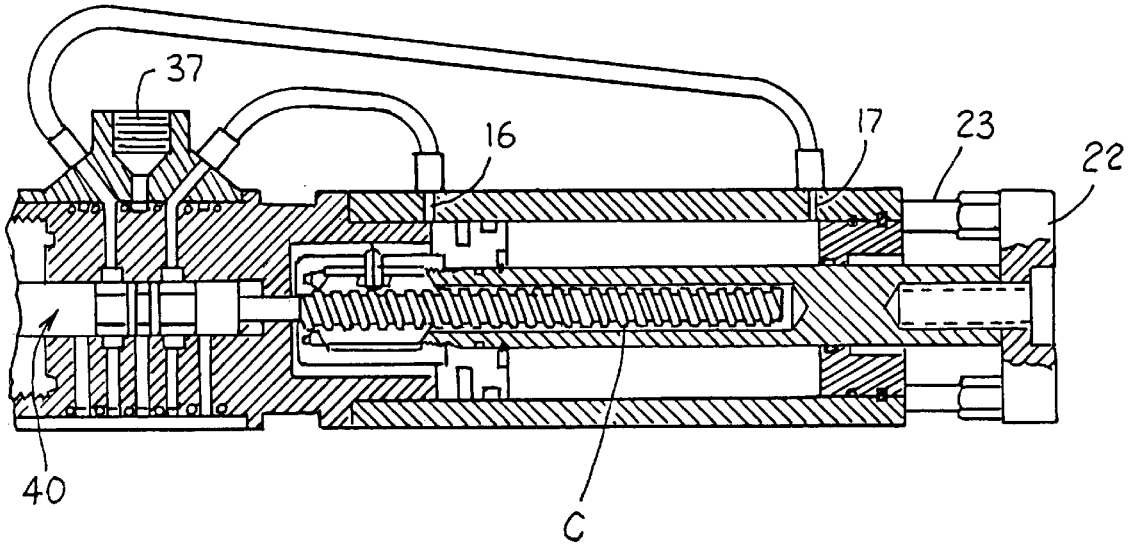
Fig. 15.

PNEUMATICALLY POWERED LINEAR ACTUATOR CONTROL APPARATUS AND METHOD

This application is a continuation-in-part of Co-pending application Ser. No. 08/610,269, filed Mar. 4, 1996, which is Continuation of application Ser. No. 08/312,057, filed Sep. 26, 1994, now abandoned entitled PNEUMATICALLY AND ELECTRICALLY OPERATED EXTENSIBLE MEMBER AND METHOD, now abandoned.

BACKGROUND OF THE INVENTION

This invention relates to controls for pneumatically powered linear actuators which include a driven elongated threaded member or lead screw that positively positions the linear actuator.

The characteristics of a pneumatic cylinder include a capability for producing great forces through the use of a readily available source of power utilizing simple inexpensive constructions. Pneumatic cylinders have a notable disadvantage in that, once in motion, it is very difficult to stop the piston rod or other operating mechanism in a precisely desired position. Electric cylinders or linear actuated devices powered by an electric motor as may be operated through the use of a screw threaded drive are relatively simple in design offering precise positioning in fast or slow motion so as to offer both position and velocity control. Such systems utilize a clean readily available power source with little or no noise or leakage problems. Since the electrically driven actuators utilize a common source of power they may interface with controllers, computers and the like. Very small power to weight ratios however, make them inefficient from the standpoint of space considerations. Moreover, loads may back drive the cylinder.

Servo controlled air cylinders provide power to weight ratios conducive to space efficiency. A feed back system may be provided for positioning each cylinder and integrated with a system of valves and feedback devices operating through a dedicated controller. Such cylinders may be infinitely positionable or positioned in discrete stroke increments. Closed loop hydraulic systems offer comparable results to electric cylinders but such cannot be utilized in pneumatic systems due to compressibility of the media. Suitable velocity control characteristics are not provided by such complicated systems.

Accordingly, it is desired to obtain positive positioning and velocity control in a pneumatically powered linear actuator by a simplified operating mechanism wherein an electric motor controls the operation of a valve for distributing pressurized air for powering the linear actuator and for fixing the linear actuator in a desired position.

SUMMARY OF THE INVENTION

Accordingly, it is an important object of this invention to provide an air cylinder affording substantial power and yet having the controllability of an electric cylinder from the standpoint of speed and positioning.

It is an important object of the invention to obtain both position and velocity control in a space efficient package.

Another important object of the invention is to provide an air operated cylinder utilizing a stepper motor controller so as to eliminate the need for feedback devices.

Another important object of the invention is to provide a stepper motor for controlling an air cylinder so that the stepper motor can be directly interfaced with controllers and computers.

Another important object of the invention is to utilize an electric motor for operating an air cylinder wherein the electric motor would be reduced in size on the other of about 1/10 that which would be required in a comparable electric cylinder.

Another important object of the invention is to provide an air cylinder controlled by an electric motor such that the friction inherent in a screw thread drive is utilized advantageously to provide self-locking so that the load cannot back drive the cylinder in case of power loss.

Still another important object of the invention is the provision of an electric control operating mechanism for an air cylinder for providing both position and velocity control and yet making it possible to match the force provided by the cylinder to the load without dependence upon an electric drive for actually moving the load.

An important object of the invention is to provide improved controls for a pneumatic linear actuator utilizing a special valve for distributing pressurized air to the cylinder and having an elongated threaded member or lead screw driven by an electric motor for positive positioning of the linear actuator.

A preferred drive includes a fixed connection of the lead screw with an axially movable valve spool on one end which in turn has an axially compliant torque transmitting member on the other end of the spool serving as a connection to the motor. A suitable axially compliant torque transmitting member for permitting longitudinal movement of the spool and for transmitting torque from the electric motor may be provided as an axially compressible bellows. Such a control for the pneumatic linear actuator wherein the electric motor is suitably controlled as by an encoder and the valve is in turn controlled responsive to the motor is an alternative to the computer controlled valve and motor also described herein. The spool may be moved axially responsive to an air operated pilot valve, utilizing a compression spring on each end of the spool for returning the spool to a neutral position, as an alternative to fixing the spool to the lead screw.

The bellows permits isolated axial movement of the lead screw in respect to the electric motor carried on one side of the air distribution valve, and a threaded member carried on the other side of the air distribution valve receives the lead screw for converting rotary motion to linear motion.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 14 is a transverse sectional elevation illustrating internal porting from the valve to the cylinder; and FIG. 15 is a transverse sectional elevation similar to FIG. 14 illustrating the parts in externally ported relation.

DESCRIPTION OF A PREFERRED EMBODIMENT

Figure 1:
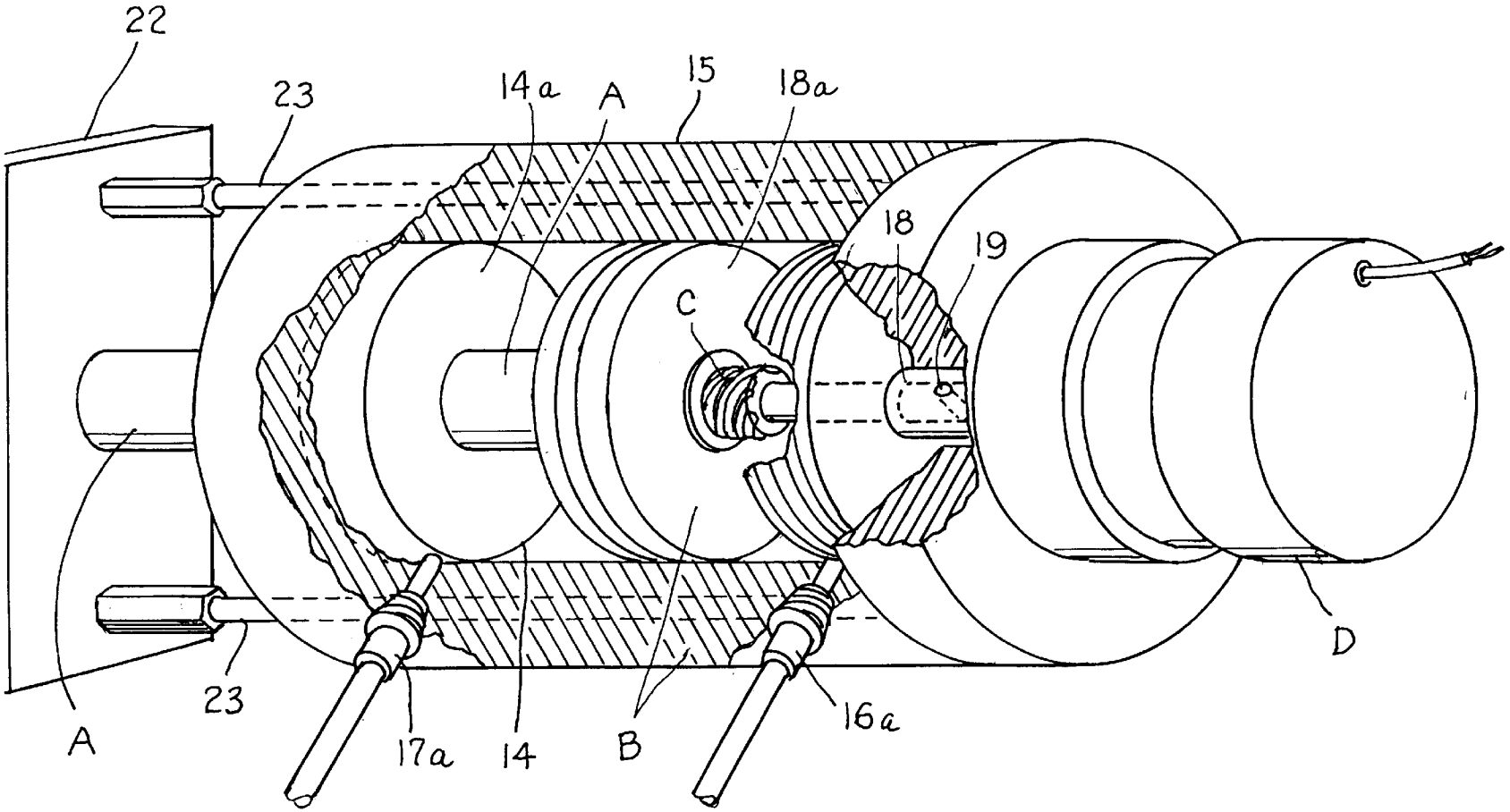
FIG. 1 is a perspective view illustrating an electric motor control for operating a pneumatic cylinder constructed in accordance with the invention.
Figure 2:
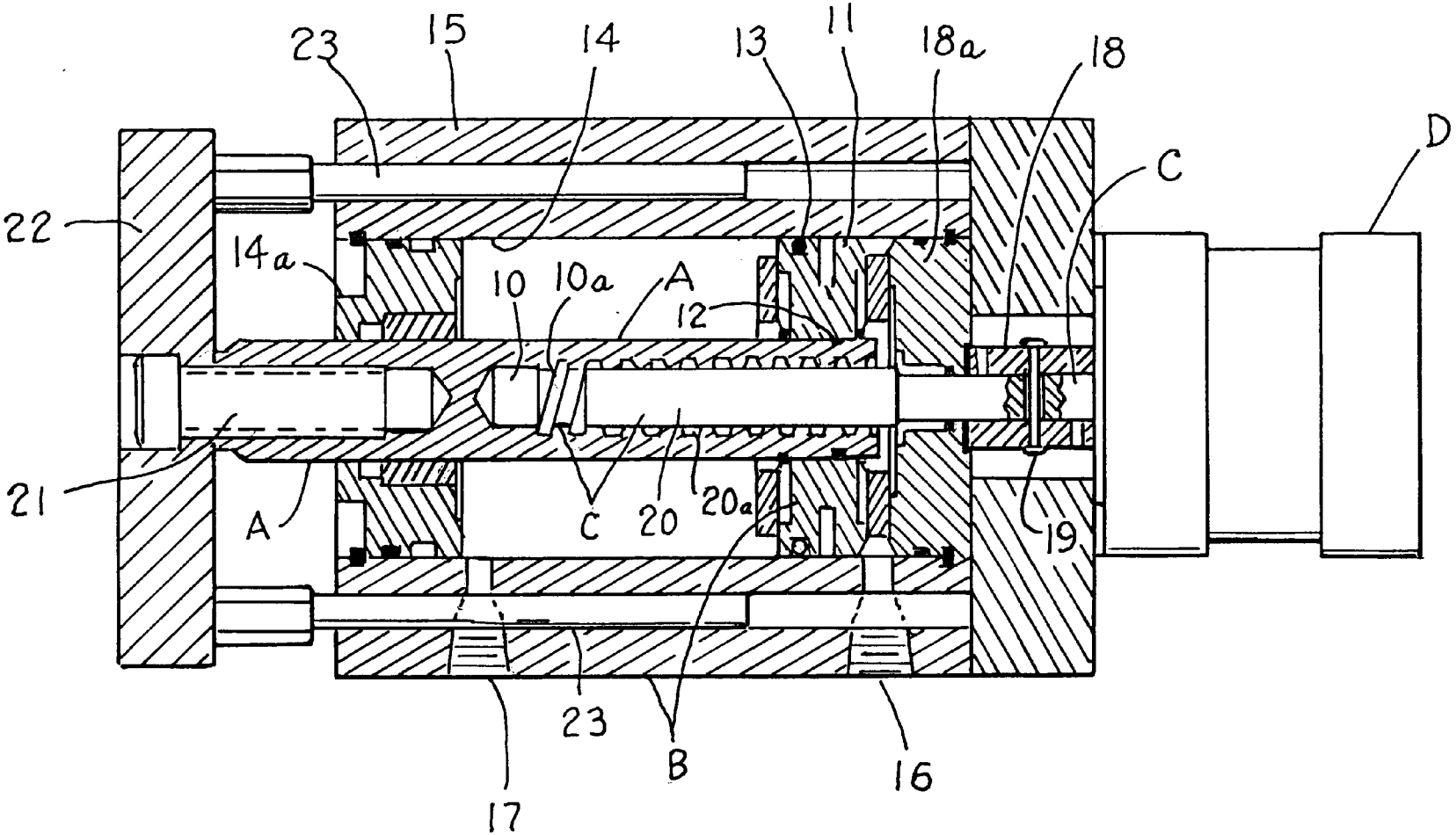
FIG. 2 is a longitudinal sectional elevation of the apparatus illustrated in FIG. 1 wherein the length of the threading of the electrically driven operator is relatively short compared to the length of the internal threading of the piston rod.
Figure 3:
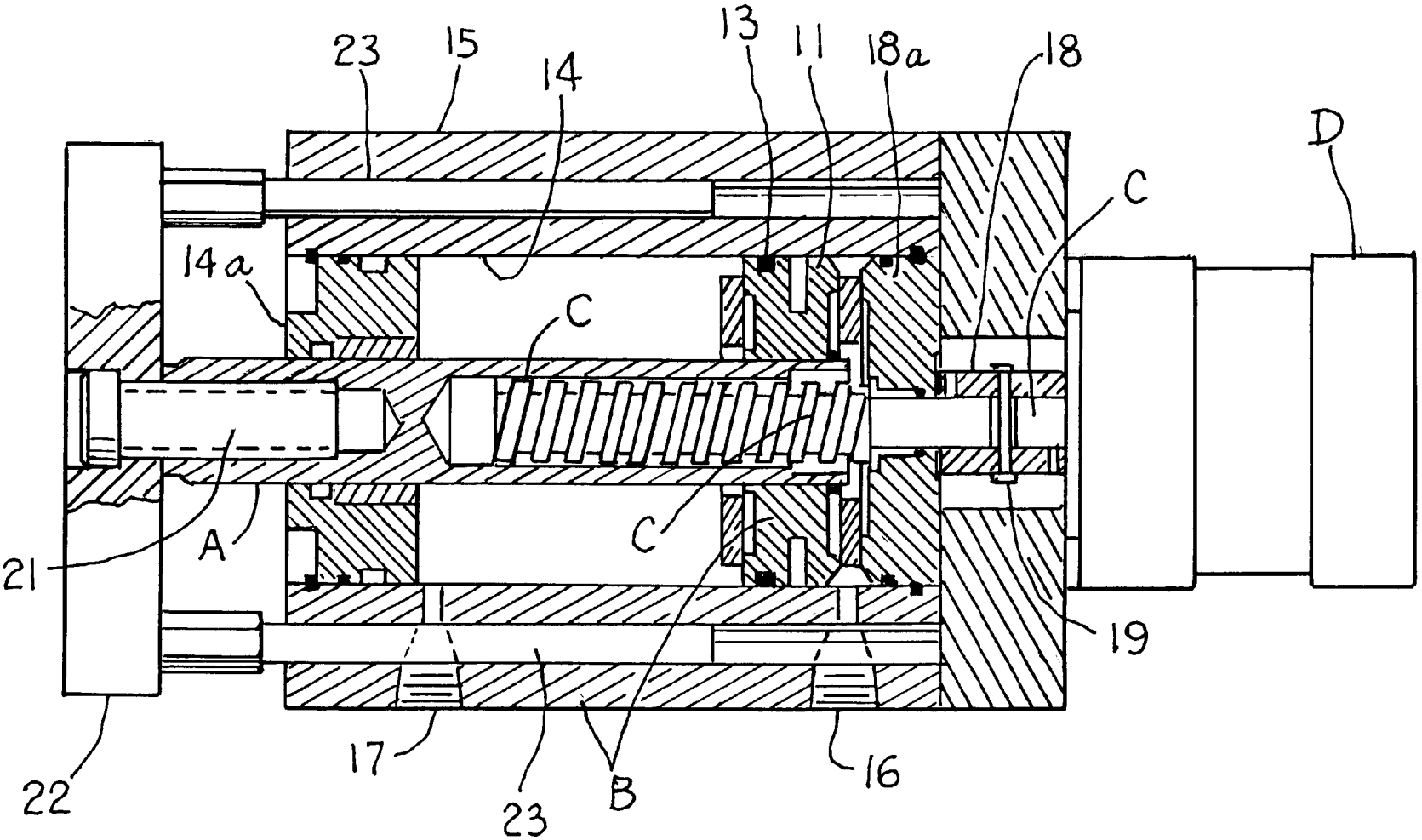
FIG. 3 is a longitudinal sectional elevation similar to FIG. 2 but illustrating a modified form of the invention wherein the internal threading of the piston rod is relatively short as compared to that of the motor driven operator.

The drawings illustrate a pneumatically powered linear actuator including an elongated extensible member having a piston rod A and an air operated apparatus B for moving the extensible member in a direction to exert a power stroke. A source of air under pressure actuates the air powered apparatus. A threaded drive C is carried for rotation in a direction permitting travel of the extensible member as powered by the pressurized air. An electric motor D actuates the threaded drive or lead screw for rotation. Thus, the air operated apparatus and the electric motor may operate to forcefully move the extensible member on a power stroke, the electric motor and threaded drive providing positive or accurate controlled positioning for the extensible member. The elongated extensible member is illustrated as including a piston rod A. The air operated apparatus B includes a cylinder, a piston carried in the cylinder, and an air inlet port connected to the source of air. The threaded drive C includes an internally threaded portion of the elongated extensible member, and an elongated externally threaded member or lead screw, driven by the electric motor D, in threaded engagement, within the internally threaded portion.

Referring especially to FIGS. 1–7, the elongated extensible member A is illustrated as including a piston rod which has a bore 10 therein with internal threads 10*a*. The piston rod has connection on one end with a piston 11 which is fastened by means of a ring 12 to the piston rod. Suitable seals including the O-ring 13 are provided for the piston within the internal cylindrical walls 14 within the cylinder housing 15. The piston 11 and the cylinder 15 and associated parts form an air operated apparatus which further includes an inlet port 16 having a fitting 16*a* which is utilized to extend the piston rod as well as a port 17 having a fitting 17*a* which is used to retract the piston rod.

The threaded drive C is connected to a power takeoff shaft by a flexible coupling schematically illustrated as including a sleeve 18 and a pin 19. A threaded shaft 20 also forms a part of the threaded drive C through the flexible coupling. The shaft 20 has external threads 20*a* in threadable engagement with the internal threads 10*a* within the bore 10 within the piston rod A. It will be observed that the power takeoff shaft extends through an internal rear end cap 18*a* in suitable sealed relation and that the piston rod A extends through a head end cap 14*a* in sealed relation thereto.

The piston rod A is connected by a threaded fastener 21 to a yoke 22. As illustrated in U.S. Pat. No. 5,113,746 the yoke has suitable connection to a pair of guide rods 23 for insuring the maintenance of accurate non rotating alignment of the piston rod. The disclosure of this patent is incorporated herein by reference.

Figure 4:
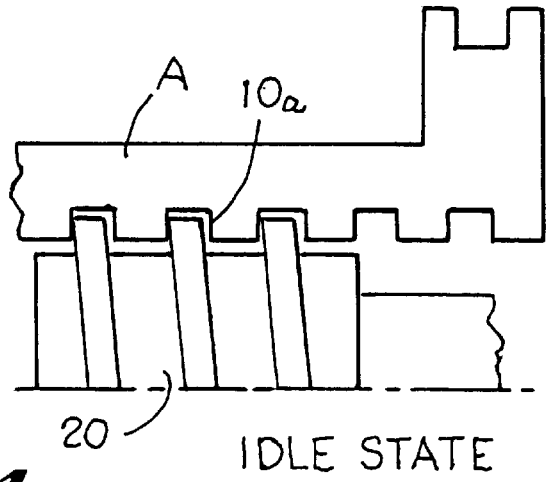
FIG. 4 is an enlarged sectional elevation illustrating the thread interface between the threaded drive members during an idle state.
Figure 5:
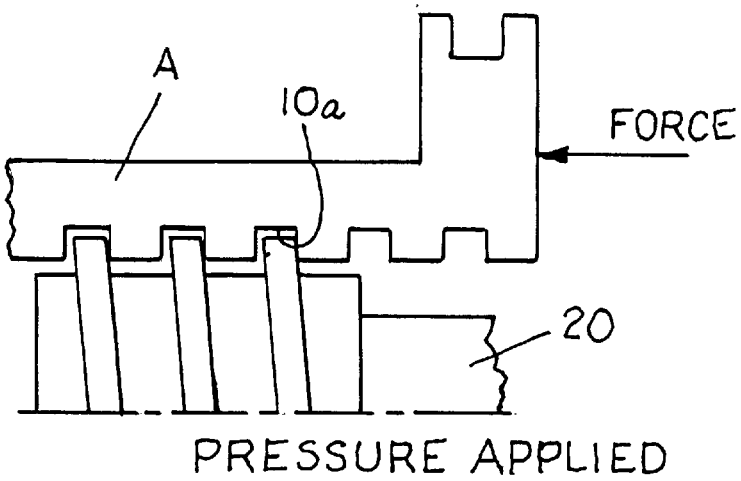
FIG. 5 is an enlarged longitudinal sectional elevation illustrating the interrelation of the threads of the electrically driven members when fluid pressure is applied.
Figure 6:
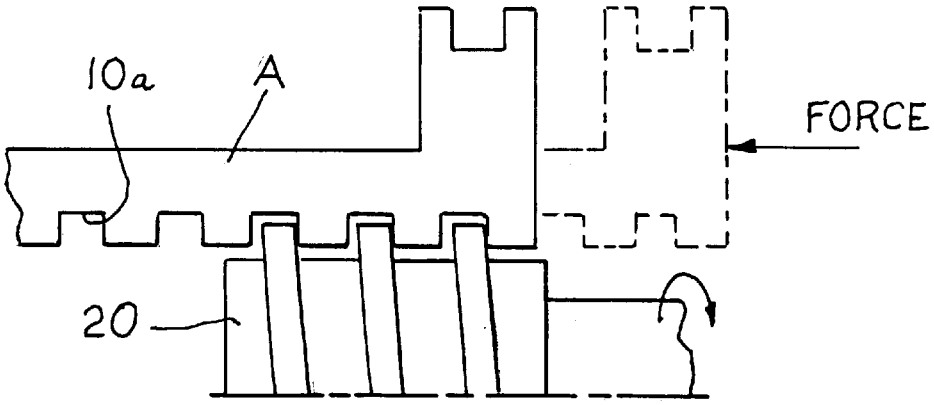
FIG. 6 is an enlarged longitudinal sectional elevation similar to FIG. 5 illustrating the relationship of the parts of the threaded drive during the application of pneumatic force and rotational force applied by the electric motor.

FIGS. 4–6 illustrate the relationship of the respective parts of the threaded drive during a sequence of operation wherein in the idling state there is only incidental engagement between the externally threaded drive shaft 20 and the internal threads 10*a* of the piston rod. In FIG. 5 the application of pneumatic forces causes the back portions of the respective threads to become engaged whereas in FIG. 6 rotation may be readily applied because such tends to move the piston rod in the same direction as that caused by the application of pneumatic force. A cessation of the application of rotational force by the electric motor brings about a cessation of movement of the piston rod A by virtue of self-locking of such screw threaded drive.

Figure 7:
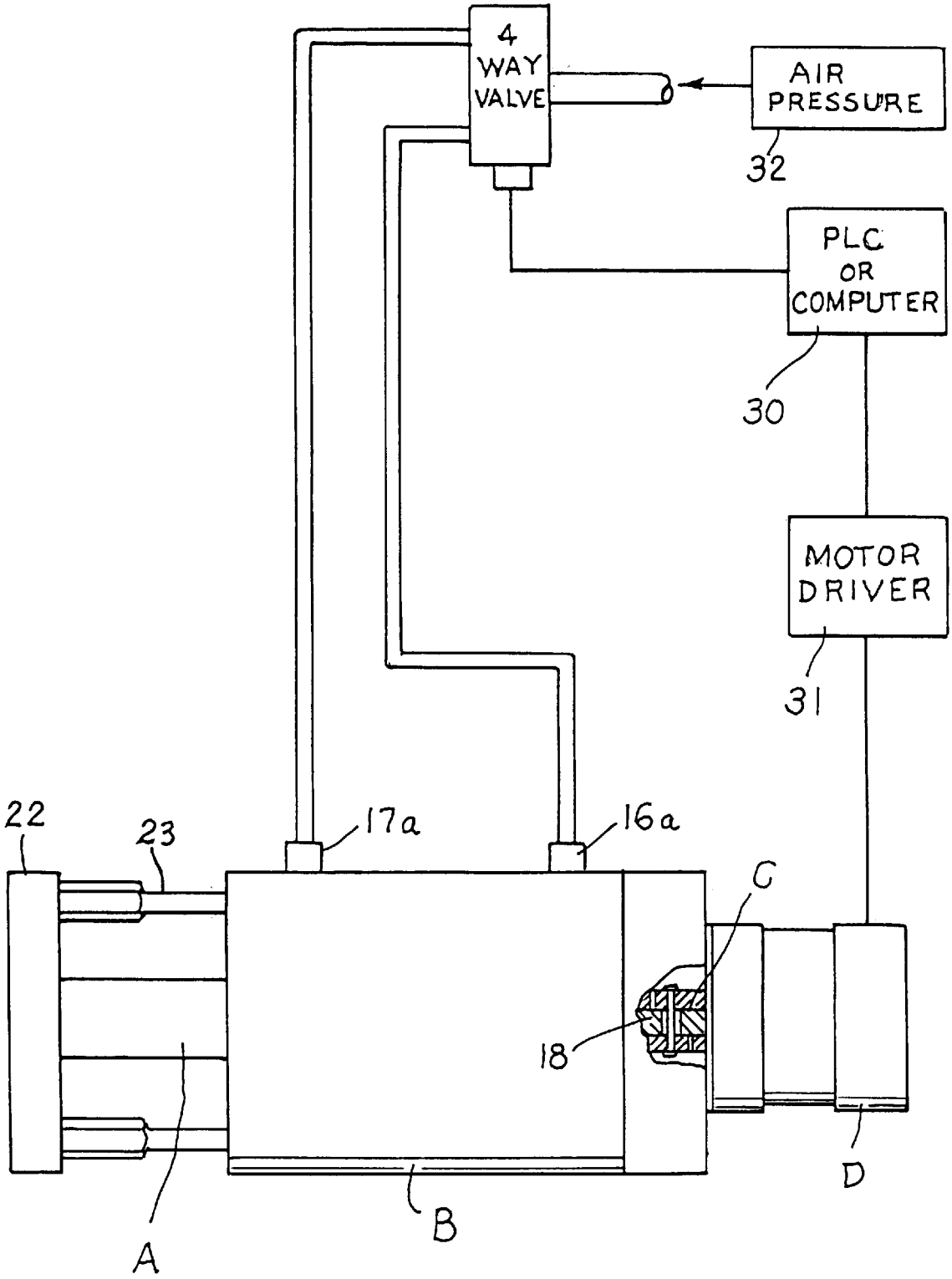
FIG. 7 is a block diagram illustrating the pneumatic and electrical components of the apparatus.

Referring more particularly to FIG. 7, it will be noted that a suitable stepper motor D may be utilized as illustrated. A programmable, logic controller or computer 30 may be utilized to operate a suitable motor driver 31 for controlling the stepper motor D. A source of air pressure 32 delivers air through a suitable 4-way valve to the connections 16*a* and 17*a* for operating the air operated cylinder B.

It is thus seen that positive positioning and velocity control is achieved for an air operated cylinder. The piston rod provides pneumatic force which is subject to positive positioning and velocity control by the electric motor. The piston rod which operates as a linear actuator may operate any desired mechanism through suitable auxiliary drives.

Motor Operated Controls for the Pneumatic Actuator

It will be noted that the pitch of the lead screw is chosen such that rotation of a driver will cause linear motion of the piston, but linear motion of the piston will not cause rotation of the driver. The electric motor is sized such that its torque output is just sufficient to overcome the friction and inertia of the apparatus, and thus move the piston rod assembly at desired rates under no load.

When loaded, pressurized air is introduced in the cylinder creating a force output equal to and opposite in direction to the load. Therefore, no load is transferred to the electric motor. This requires the use of a load sensing fluid control valve or a manually adjusted valve may be utilized if the application calls for a constant load service. Since the thread chosen is self-locking, no motion of the load is possible unless the motor rotates. By controlling the direction, speed and acceleration of the motor, the same attributes of the load can be controlled. Using an automatically adjusting control valve as described below, fluctuating loads with more complex motion profiles can be handled. Changes in environmental and load conditions do not effect the reliability of the system. By utilizing the controls hereof, the load itself is no longer a factor and therefore, so long as it never exceeds the rating of the actuator, load fluctuations will have no effect on actuator function.

FIGS. 8–15 illustrate a modified control apparatus for a linear actuator having an extensible member A, an air operated apparatus B including a cylinder extending and retracting a piston for moving an external load, and an elongated threaded member or lead screw C carried in alignment in the cylinder and driven by an electric motor D for positioning the load. A valve housing broadly designated at 35 is positioned between the electric motor and the cylinder for selectively distributing air under pressure to an extend side of the cylinder or to a retract side of the cylinder. A valve spool broadly designated at 40 is axially positioned in the valve housing being connected on one end to and in alignment with the elongated threaded member C and on the other end to an in alignment with the electric motor D for controlling the selective distribution of air. An assembly broadly designated at 45 moves the valve spool toward the electric motor responsive to rotation of the elongated threaded member in one direction and toward the cylinder responsive to rotation of the elongated threaded member in the other direction. A coupling broadly designated at 50 connects the other end of the valve spool to the electric motor D permitting movement of the valve spool 40 and driving of the elongated threaded member C for rotation.

As described above in connection with the embodiment of FIGS. 1–7, external load on the pneumatically powered linear actuator is balanced against the force generated by air pressure on the piston 11. The resultant force is preferably almost zero. A small electric motor D together with the load screw C is thus used to position the piston and the external load at any desired location. The apparatus and method used to regulate air supply such that any external load is always balanced includes controlling a valve 35 for selectively supplying air under pressure for powering the piston 11 and the extensible assembly carried thereby.

Figure 8:
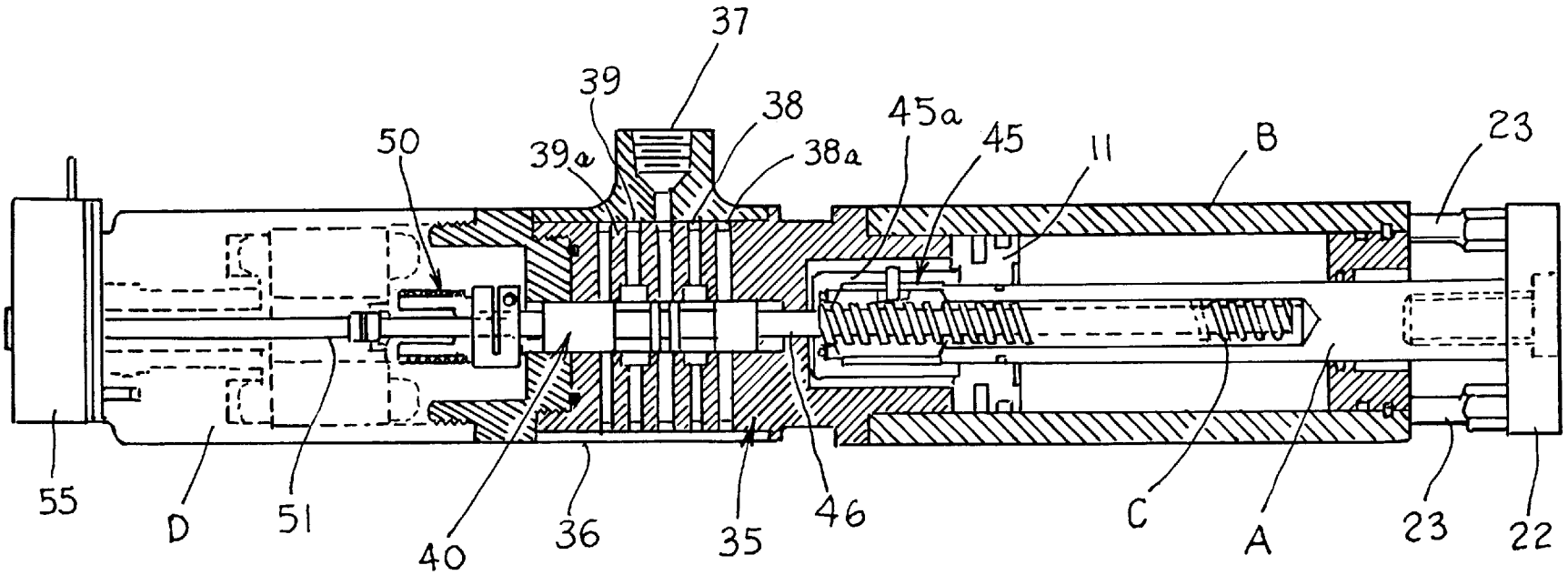
FIG. 8 is a longitudinal sectional elevation illustrating a pneumatically powered linear actuator with electric motor control therefor constructed in accordance with a modified form of the invention.
Figure 9:
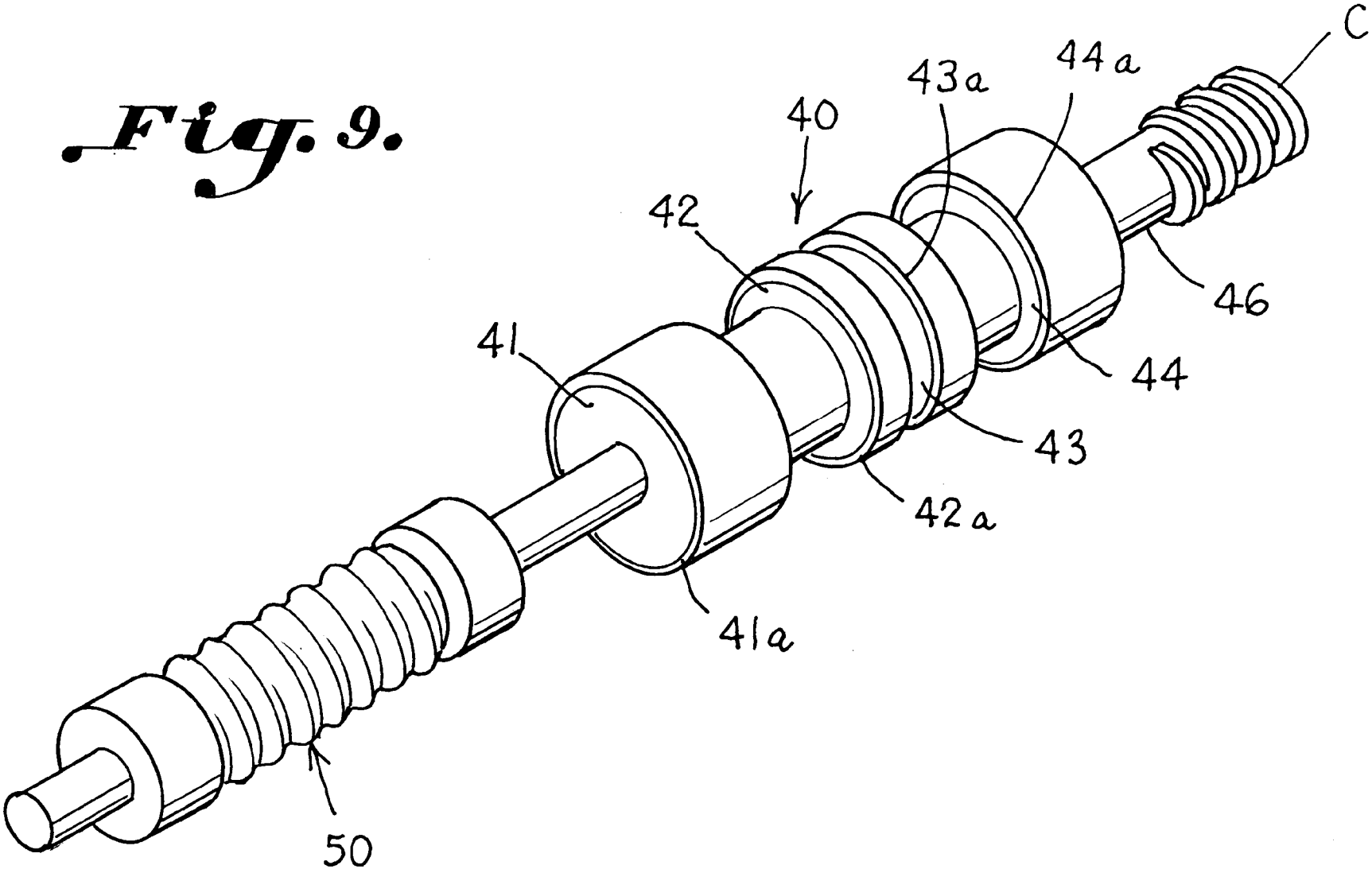
FIG. 9 is a perspective view illustrating a spool for axial positioning within a control valve between a pneumatically powered piston and an electric motor control apparatus.
Figure 10:
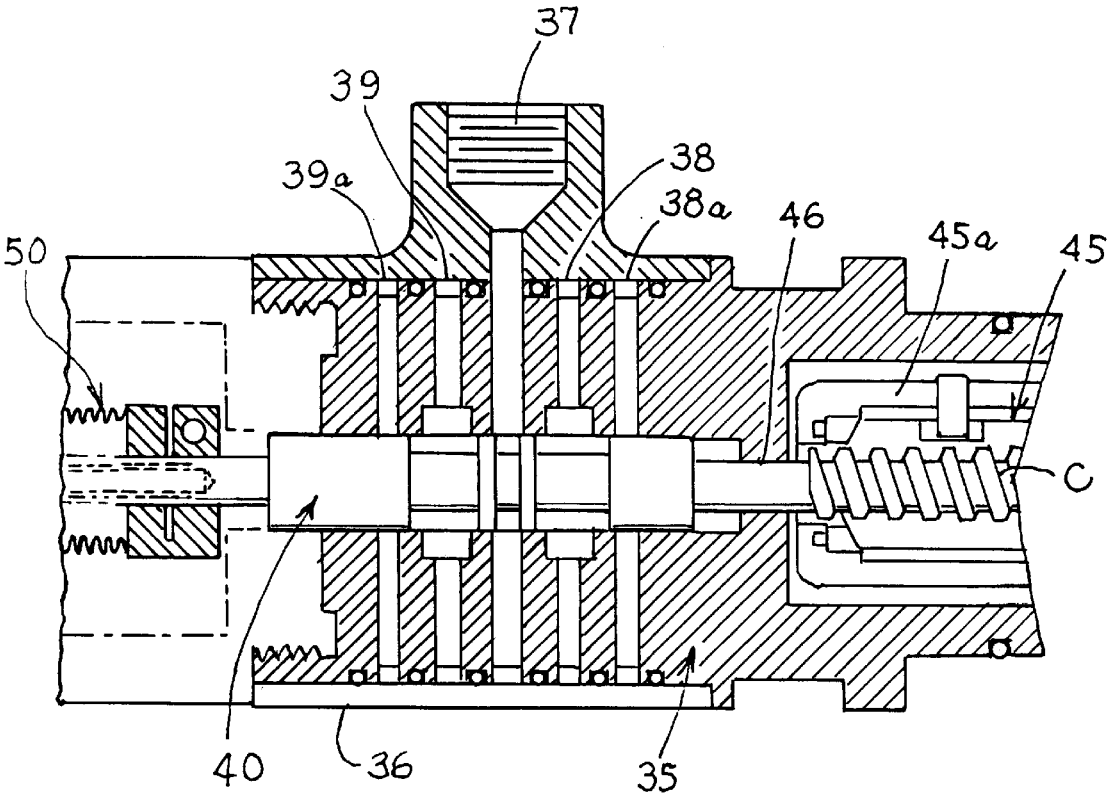
FIG. 10 is an enlarged transverse sectional view similar to FIG. 8 illustrating the spool in neutral position wherein it is designed to return.
Figure 11:
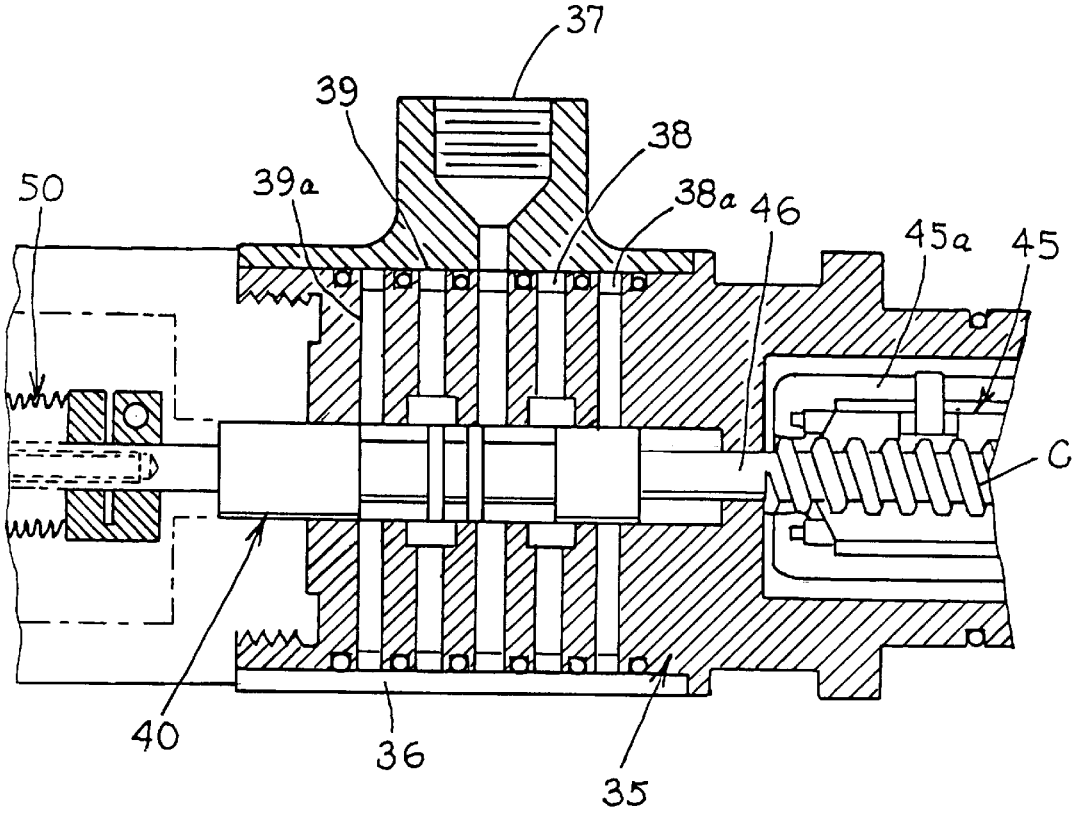
FIG. 11 is an enlarged sectional elevation similar to FIG. 10 showing the spool and associated parts in position for initiating a power stroke of the actuator cylinder for an extend mode.
Figure 12:
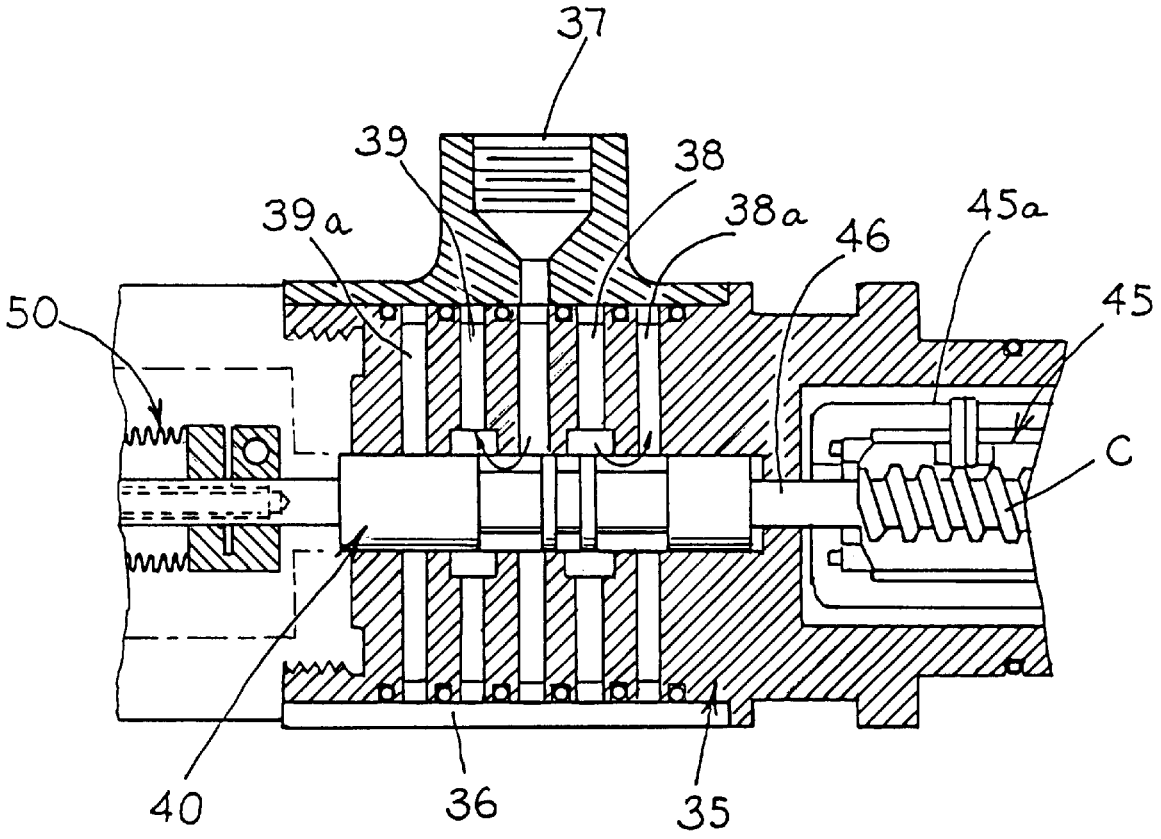
FIG. 12 is an enlarged longitudinal sectional elevation similar to FIGS. 10 and 11 illustrating the spool and related parts for a retract mode of operation.

The apparatus includes the control valve 35 carried within a housing 36 between the pneumatic cylinder on the right in FIG. 8 and the electric motor on the left. An inlet 37 supplies pressurized air from a suitable source to the valve 35 for selective distribution to the inlet 16 (FIGS. 14 and 15)through extend port 38 utilizing extend side exhaust port 39*a* (FIG. 11). Likewise, ports 39 and 38*a* provide porting for the exhaust mode (FIG. 12). The spool 40 inside the valve housing 36 shifts axially either to the left or right to connect one of the ports on the pneumatic cylinder respectively to supply pressure or to exhaust as described above. The valve thus constitutes a direct acting mechanical servo system. The only stable state for the spool is achieved by permitting the spool to assume the neutral or at rest position where none of the ports are connected. Whenever the spool is forcibly shifted from this position, a number of events are triggered thereby that take place before the spool returns to neutral state of FIG. 10. The spool 40 is best illustrated in FIG. 9 as having cylindrical sealing members 41, 42, 43, and 44, coated with elastomer sealing members as at 41*a*, 42*a*, 43*a* and 44*a* respectively, defining connecting passageways therebetween.

The spool 40 is illustrated as being integrally connected to the lead screw C on one end as at 46 and connected through the axially compliant bellows 50 to the electric motor output shaft 51 on the other end. The connection between the motor output shaft and the spool is through the axially flexible, but substantially torsionally rigid coupling provided as by the bellows 50. The bellows processes sufficient motor rigidity to transmit torque from the motor D to the lead screw C. The lead screw C threadably engages an internally threaded positioning nut 45 within a housing 45*a* that is fixed to the piston. The piston shaft assembly is constrained by guide rods 23 such that the only allowed motion is linear and no rotation occurs.

To extend the actuator, the motor is turned counterclockwise causing the lead screw C to turn in respect of the nut 45. The nut remains stationary because it is fixedly mounted on the trailing end of the piston. The screw moves to the left, shifting the spool in the same direction connecting pressurized air to the extend port and connecting the retract port to exhaust. A pressure build up now occurs in the extend chamber. When this pressure is enough to overcome the load, the actuator's piston shaft assembly moves to the right. When this assembly A moves, it also moves the nut 45 thereby carrying the lead screw C to the right.

Figure 13:
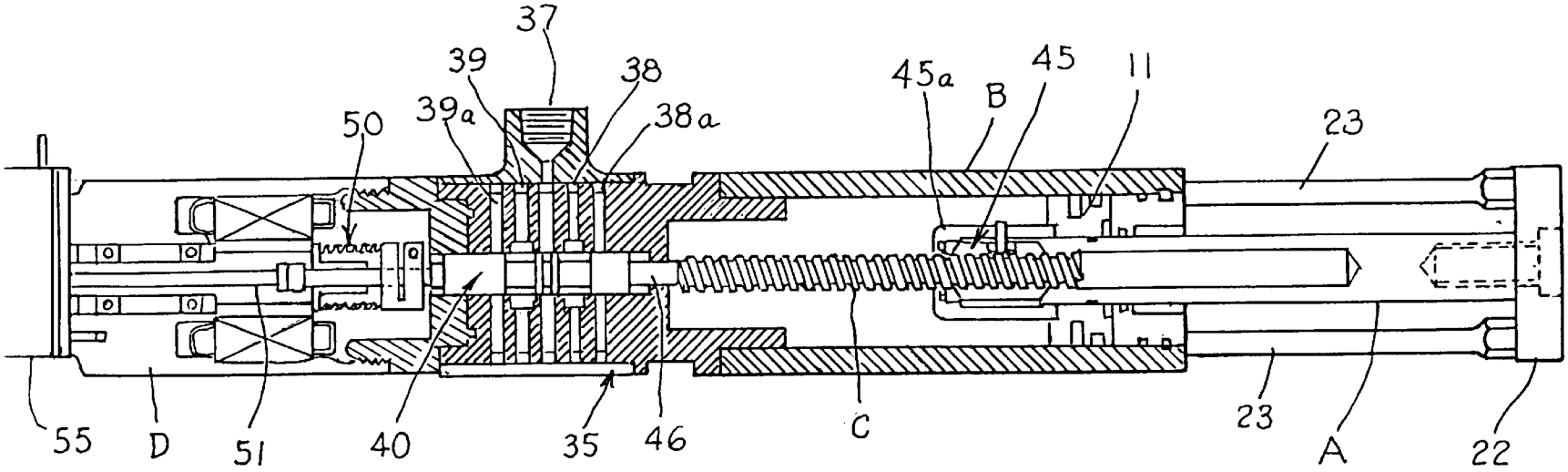
FIG. 13 is a longitudinal sectional elevation similar to FIG. 8 illustrating the linear actuator and control elements in fully extended position with the spool returned to a neutral position.

Upon completion of a power stroke, actuating movement of the spool 40 caused by rotation of the motor is now canceled by motion of the piston shaft assembly and the spool again returns to its neutral position when the linear actuator is fully extended as illustrated in FIG. 13. Thus, by continuously operating the electric motor, the piston shaft assembly A can be continuously moved in one direction as permitted by the continuous rotation of the lead screw C. By knowing the pitch or distance traversed per revolution of the lead screw, the actuator's motion can be controlled by determining the velocity, direction and number of turns of the electric motor. This is easily accomplished by using conventional servo motor technology to provide suitable signals through the encoder 55 to the motor D.

To make the actuator retract, the motor is rotated in the opposite or clockwise direction. This causes the spool to shift to the right in FIG. 12 supplying the retract port 39 of the cylinder. When the pressure buildup on the retract side overcomes the load, the actuator retracts. When no rotation is applied there is no relative motion between the load screw and nut. Therefore, the spool remains in neutral state completely sealing both extend and retract ports. This causes the actuator to hold a given position.

It should be noted that piston movement is always opposite to the spool's direction of movements. Whenever the spool is shifted from neutral, a set of events are triggered that brings the spool back to neutral.

A desired actuator position is achieved by rotating the motor as discussed above. The number of motor turns is directly proportional to actuator movement. The desired position is maintained regardless of external factors. Once rotation of the motor is stopped, the actuator must maintain the desired position even if external forces change.

For example, assuming the actuator has just positioned a given load at the desired location, the pressure in the cylinder is now equal to this load, and the motor is at rest. If the load increases, the pressure in the cylinder can no longer support this increased load and, therefore, the piston assembly will move, causing the spool to shift towards the motor end, connecting the extend chamber of the cylinder to supply pressure. Instantaneously, the extend chamber is pressurized until the increased load is overcome and the piston moves back to original position, bringing the spool back to neutral.

No actuator motion is permitted while the motor is at rest. By electronically controlling the motor's motion using an encoder for position feedback, very accurate linear motion can be produced.

While a preferred embodiment of the invention has been described using specific terms, such description is for illustrative purposes only, and it is to be understood that changes and variations may be made without departing from the spirit or scope of the following claims.

What is claimed is:

1. Control apparatus for a linear actuator having an extensible member, an air operated apparatus including a cylinder extending and retracting a piston for moving an external load, and an elongated threaded lead screw carried in alignment in said cylinder and driven by an electric motor for positioning the load comprising:

a valve housing positioned between said electric motor and said cylinder for selectively distributing air under pressure to an extend side of said cylinder and to a retract side of said cylinder;

a valve spool in said valve housing connectable on one end to and in alignment with said elongated threaded lead screw and on the other end to and in alignment with said electric motor for controlling said selectively distributing air;

an assembly for moving said valve spool toward said electric motor responsive to rotation of said elongated threaded member in one direction and toward said cylinder responsive to rotation of said elongated threaded member in the other direction and a coupling connecting the other end of said valve spool to the electric motor permitting said moving of said valve spool and driving said elongated threaded lead screw for said rotation.

2. The control apparatus set forth in claim 1 wherein said spool is fixedly connected to an adjacent end of said lead screw.

3. The control apparatus set forth in claim 1 wherein said spool is connected to an output shaft of said electric motor through an axially compressible coupling having sufficient rigidity to transmit torque from said electric motor to rotate said lead screw.

4. The control apparatus set forth in claim 3 wherein said coupling is a compressible bellows in axial alignment with said output shaft and said spool.

5. The control apparatus set forth in claim 1 wherein said assembly includes a nut fixed in respect to said piston engaging the threads of said lead screw; and means fixing said piston against rotary motion.

6. The control apparatus set forth in claim 1 wherein said spool includes integral longitudinally spaced annular sealing members arranged to be moved to selected sealing positions distributing air under pressure from said valve.

7. Control apparatus for a linear actuator having an extensible member, an air operated apparatus including a cylinder extending a piston carrying the extensible member for moving an external load, and an elongated threaded lead screw carried in alignment in said cylinder and driven by an electric motor for positioning the load comprising;

a valve positioned between said electric motor and said cylinder for selectively distributing air under pressure to an extend side of said cylinder;

a valve spool in said valve connectable on one end to and in alignment with said elongated threaded lead screw and on the other end to an in alignment with said electric motor for controlling said selectively distributing air;

an assembly for moving said valve spool toward said electric motor responsive to rotation of said elongated threaded member in one direction; and a coupling connecting the other end of said valve spool to the electric motor permitting said moving of said valve spool and driving said elongated threaded lead screw for said rotation.

8. The control apparatus set forth in claim 7 wherein said coupling is axially compressible and in axial alignment with said electric motor.

9. A method of controlling a linear actuator having an extensible member, an air operated apparatus including a cylinder extending and retracting a piston for moving an external load, and an elongated threaded member carried in alignment in said cylinder and driven by an electric motor for positioning the load comprising:

positioning a valve between said electric motor and said cylinder;

selectively distributing air under pressure to an extended side of said cylinder and to a retract side of said cylinder through said valve;

connecting a valve spool in said valve on one end to and in axial alignment with said elongated threaded member and on the other end to and in alignment with said electric motor controlling said selectively distributing air to said cylinder;

moving said valve spool in respect to said electric motor responsive to rotation of said elongated threaded member, and connecting the other end of said valve spool to the electric motor permitting said moving of said valve spool and driving said elongated threaded member for said rotation.

10. The method set forth in claim 9 including the steps of providing a fixed connection between said spool and said elongated threaded member on one end; and providing an axially compliant connection to the other end capable of delivering torque from the motor to the threaded members.

11. The method set forth in claim 10 including the step of providing a nut fixed with respect to said piston on engagement with threads of said threaded member; and securing said piston against rotation.

* * * * *